US012607424B2

(12) United States Patent
Muska

(10) Patent No.: US 12,607,424 B2
(45) Date of Patent: Apr. 21, 2026

(54) LAST ROUND HOLD OPEN

(71) Applicant: Smith & Wesson Inc., Springfield, MA (US)

(72) Inventor: Simon M. Muska, Enfield, CT (US)

(73) Assignee: Smith & Wesson Inc., Maryville, TN (US)

( * ) Notice: Subject to any disclaimer, the term of this patent is extended or adjusted under 35 U.S.C. 154(b) by 138 days.

(21) Appl. No.: 18/744,997

(22) Filed: Jun. 17, 2024

(65) Prior Publication Data

US 2024/0418464 A1 Dec. 19, 2024

Related U.S. Application Data

(60) Provisional application No. 63/508,433, filed on Jun. 15, 2023.

(51) Int. Cl.
*F41A 17/36* (2006.01)
*F41A 3/70* (2006.01)

(52) U.S. Cl.
CPC ..... *F41A 3/70* (2013.01); *F41A 17/36* (2013.01)

(58) Field of Classification Search
CPC .... F41A 3/68; F41A 3/70; F41A 17/36; F41A 17/40; F41A 17/42
See application file for complete search history.

(56) References Cited

U.S. PATENT DOCUMENTS 2,548,622 A 4/1951 Sampson et al.
3,846,928 A * 11/1974 Ruger ..... F41A 17/36 89/138
6,510,778 B1 1/2003 Irwin
9,494,378 B2 * 11/2016 Gomez ..... F41A 17/42
9,719,742 B2 * 8/2017 Zeman ..... C22C 29/16
9,952,011 B2 * 4/2018 Overstreet ..... F41A 17/36
10,018,437 B2 7/2018 Phipps et al.
10,180,298 B2 * 1/2019 Noonan ..... F41A 17/36
10,890,394 B2 * 1/2021 Denson, III ..... F41A 17/36
10,921,077 B2 * 2/2021 Noonan ..... F41A 3/66
11,085,715 B2 8/2021 Stroda
11,512,920 B1 * 11/2022 Oglesby ..... F41A 17/42
2005/0000138 A1 * 1/2005 Kiss ..... F41A 17/36 42/50
2012/0167424 A1 * 7/2012 Gomez ..... F41A 35/06 42/14
2017/0160032 A1 * 6/2017 Overstreet ..... F41A 17/36
(Continued)

*Primary Examiner* — Derrick R Morgan
(74) *Attorney, Agent, or Firm* — Ballard Spahr LLP

(57) ABSTRACT

An assembly for holding a bolt of a firearm in an open position is disclosed. The assembly comprises a bolt catch pivotable about a first axis toward and away from a catching position. In the catching position, a portion of the bolt catch is within a path of travel of the bolt. A follower transfer adapter is pivotable about a second axis. The follower transfer adapter includes an engagement portion that is configured to engage a follower of a magazine. Optionally, the follower transfer adapter includes an overhang lip that extends transversely to the longitudinal axis of the firearm and into a path of travel of the follower to define the engagement portion. The engagement portion is positioned between the second axis and the bolt catch along the longitudinal axis of the firearm. A linkage transfers rotational movement of the follower transfer adapter to rotation of the bolt catch.

17 Claims, 9 Drawing Sheets

(56) References Cited

U.S. PATENT DOCUMENTS

| | | | | |
|---|---|---|---|---|
| 2017/0241729 | A1* | 8/2017 | Gangl | F41A 3/66 |
| 2017/0284761 | A1* | 10/2017 | Lewis | F41A 17/36 |
| 2019/0078850 | A1* | 3/2019 | Cross | F41A 11/00 |
| 2019/0301822 | A1* | 10/2019 | Laney | F41A 9/73 |
| 2020/0182571 | A1* | 6/2020 | Noonan | F41A 3/66 |
| 2021/0164747 | A1* | 6/2021 | Denson, III | F41A 9/59 |
| 2021/0278156 | A1* | 9/2021 | Davidson | F41A 9/70 |
| 2022/0373282 | A1* | 11/2022 | Cheng | F41A 17/36 |
| 2024/0361093 | A1* | 10/2024 | Hubbell | F41A 3/68 |

* cited by examiner

LAST ROUND HOLD OPEN

CROSS-REFERENCE TO RELATED APPLICATIONS

This application claims priority to and the benefit of the filing date of U.S. Provisional Patent Application No. 63/508,433, filed Jun. 15, 2023, the entirety of which is hereby incorporated by reference herein.

FIELD

This disclosure relates to bolt catches for firearms.

BACKGROUND

It is advantageous that the bolt of a semiautomatic firearm, such as a rifle, be held out of battery in an open position after the last cartridge has been expended. The bolt, held out of battery, immediately alerts the shooter that the magazine is empty and that it is time to reload. Typically, the follower of the magazine engages a structure that moves a bolt catch for catching the bolt. However, magazines and their followers differ, so the bolt catch is configured for engagement with only one type of magazine.

It is therefore desirable to be able to adapt a bolt catch for different magazines.

SUMMARY

Aspects of this invention concern a firearm having a bolt catch. In an aspect, an assembly for holding a bolt of a firearm in an open position is disclosed, the firearm having a longitudinal axis. The assembly includes a bolt catch pivotable about a first axis toward and away from a catching position. In the catching position, a portion of the bolt catch is within a path of travel of the bolt. A follower transfer adapter is pivotable about a second axis. The follower transfer adapter includes an engagement portion that is configured to engage a follower of a magazine. In various examples, the follower transfer adapter includes an overhang lip that extends transversely (optionally, perpendicularly or substantially perpendicularly) to the longitudinal axis of the firearm and into a path of travel of the follower to define the engagement portion. The engagement portion is positioned between the second axis and the bolt catch along the longitudinal axis of the firearm. A linkage is configured to transfer rotational movement of the follower transfer adapter to rotation of the bolt catch.

In one aspect, the linkage includes a first lever that is pivotable about a third axis that is parallel or substantially parallel (e.g., within 10 degrees of parallel) to the second axis. A second lever is pivotable about a fourth axis that is parallel or substantially parallel (e.g., within 10 degrees of parallel) to the second and third axes. The first lever is in contact with the follower transfer adapter so that rotation of the follower transfer adapter effects rotation of the first lever. The first lever is in contact with the second lever so that rotation of the first lever effects rotation of the second lever. The second lever is in contact with the bolt catch so that rotation of the second lever effects rotation of the bolt catch. In some examples, the second lever includes a leg that cooperates with the frame to counteract a moment force perpendicular to the fourth axis.

In one embodiment, the assembly includes a biasing element that biases the bolt catch away from the catching position.

In exemplary aspects, the follower transfer adapter includes a rearwardly extending leg that biases against a front portion of the first lever. Optionally, in these aspects, the front portion of the first lever comprises a rounded surface that contacts the rearwardly extending leg of the follower transfer adapter. In some examples, the second lever includes a rear portion and a front portion, wherein the assembly is configured so that rotation of the follower transfer adapter upon engagement with the follower lifts the front portion of the first lever. Upon lifting of the front portion of the first lever, a rear portion of the first lever is configured to bias downwardly on the front portion of the second lever. Upon downward bias of the rear portion of the first lever on the front portion of the second lever, a rear leg of the second lever is configured to bias upwardly against the bolt catch.

In some aspects, the engagement portion of the follower transfer adapter is configured to engage the follower of the magazine as the follower feeds the last round from the magazine to the firearm.

In an aspect, the bolt catch includes an actuator that pivots outwardly as the bolt catch moves to the catching position.

In some embodiments, the follower transfer adapter defines a through-hole. The assembly further includes a pivot pin that extends through the through-hole of the follower transfer adapter. The second axis extends through a central axis of the pivot pin.

In various embodiments, the second axis is transverse to the longitudinal axis of the firearm. In some optional aspects, the second axis is perpendicular or substantially perpendicular (e.g., within 10 degrees of perpendicular) to the longitudinal axis of the firearm.

In another example, an assembly for holding a bolt of a firearm in an open position is disclosed, the firearm having a longitudinal axis. The assembly includes a bolt catch pivotable about a first axis. In one aspect, the first axis is parallel or substantially parallel (e.g., within 10 degrees of parallel) to the longitudinal axis of the firearm. A follower transfer adapter is pivotable about a second axis. The follower transfer adapter includes an engagement portion that is configured to engage a follower of a magazine. A linkage is configured to transfer rotational movement of the follower transfer adapter to rotation of the bolt catch. The linkage includes a first lever that is pivotable about a third axis that is parallel or substantially parallel (e.g., within 10 degrees of parallel) to the second axis.

A second lever is pivotable about a fourth axis that is parallel or substantially parallel (e.g., within 10 degrees of parallel) to the second and third axes. The first lever is in contact with the follower transfer adapter so that rotation of the follower transfer adapter effects rotation of the first lever. The first lever is in contact with the second lever so that rotation of the first lever effects rotation of the second lever. The second lever is in contact with the bolt catch so that rotation of the second lever effects rotation of the bolt catch.

Also disclosed is a firearm including the assembly as disclosed herein. In one aspect, the firearm includes the magazine.

Further disclosed is a method for adapting the firearm for a particular magazine. The method includes positioning, within the firearm, the follower transfer adapter, the follower transfer adapter being configured for use with the magazine. In some aspects, a pivot pin is inserted through the through-hole of the follower transfer adapter. In further aspects, the pivot pin is removed from the through hole of the follower transfer adapter. The follower transfer adapter is removed from the firearm. A second follower transfer adapter is positioned within the firearm, wherein the second follower transfer adapter includes a through hole. The pivot pin is inserted through the through hole of the second follower transfer adapter.

DETAILED DESCRIPTION

Figure 1:
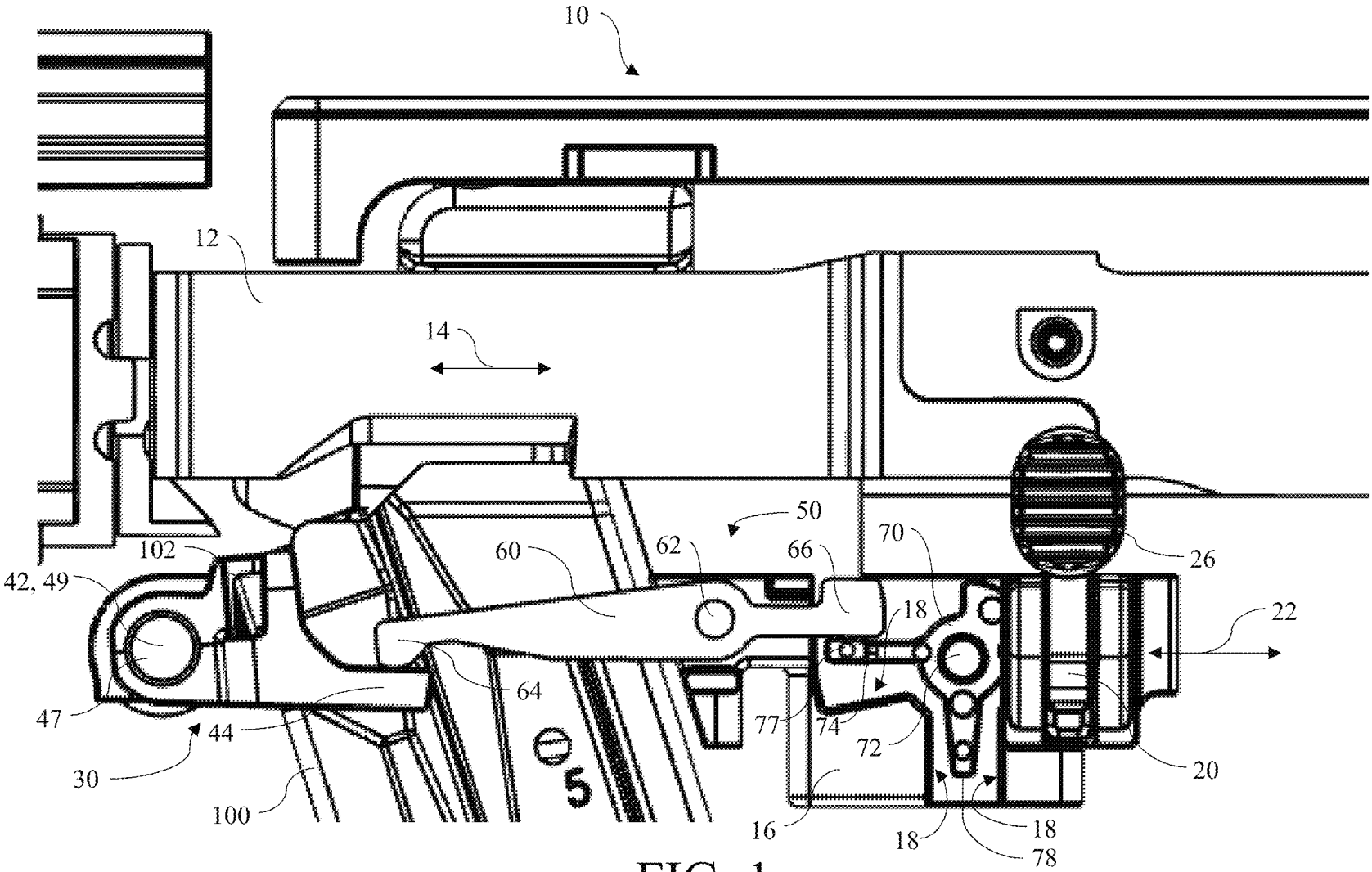
FIG. 1 is a side view of a portion of a firearm, with elements omitted to show components of an exemplary assembly for holding a bolt open, as disclosed herein.

FIG. 1 is a side view of an example firearm 10 according to the invention, with certain components hidden to show inner components. In this example, the firearm 10 is depicted as a semi-automatic rifle, however, it is contemplated that other firearm designs and configurations can be compatible with the current disclosure. The firearm 10 includes a bolt 12 that moves reciprocally along a longitudinal axis 14 relative to a frame 16. The frame 16 can include, for example, an upper receiver (not shown to reveal underlying components). The firearm receives a magazine 100 having a follower 102 that feeds rounds into the firearm.

A bolt catch 20 is configured to hold the bolt in an open position when the last round is fired. The bolt catch 20 is pivotably coupled to the frame 16 about a first axis 22 that is transverse to the longitudinal axis 14. In exemplary aspects, the bolt catch 20 can be indirectly coupled to the frame 16 (e.g., a lower receiver) via an insert that, in turn, couples to the frame. In alternative aspects, the bolt catch can be directly coupled to the frame. Optionally, the first axis 22 can be perpendicular or substantially perpendicular (e.g., within 10 degrees of perpendicular) to the longitudinal axis 14. The bolt catch 20 is pivotable about and between a catching position, in which a portion 24 of the bolt catch is within a path of travel of the bolt 12, and a second position, in which said portion 24 of the bolt catch is pivoted away from the path of travel of the bolt 12. In other words, when the bolt catch 20 is in the catching position, the bolt engages the bolt catch during reciprocation of the bolt 12, and, when the bolt catch 20 is in the second position, the bolt does not engage the bolt catch during reciprocation.

The bolt catch 20 comprises an actuator 26 that pivots outwardly as the bolt catch moves to the catching position. The actuator 26, in this example, is a lever that permits a user to pivot the bolt catch to the second position. The actuator 26, in this example, is integrally formed with the bolt catch 20. A biasing element, in this example, a spring 28, biases the bolt catch 20 away from the catching position, toward the second position. In alternative embodiments, it is contemplated that the actuator 26 can be formed separately from the bolt catch. In further alternative embodiments, it is contemplated that the actuator can have other suitable structures (e.g., arms) that permit a user to effect pivotal movement of the bolt catch as disclosed herein.

Figure 5:
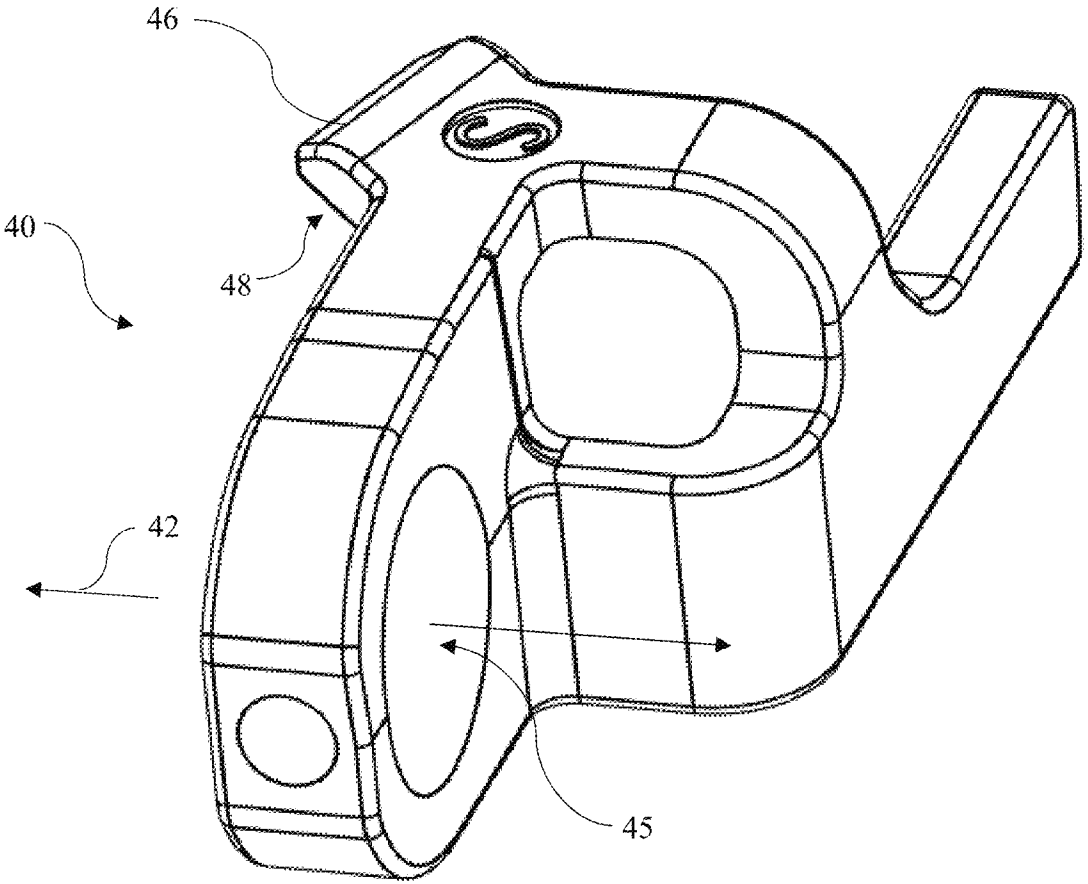
FIG. 5 is a perspective view of an exemplary follower transfer adapter as disclosed herein.
Figure 6A:
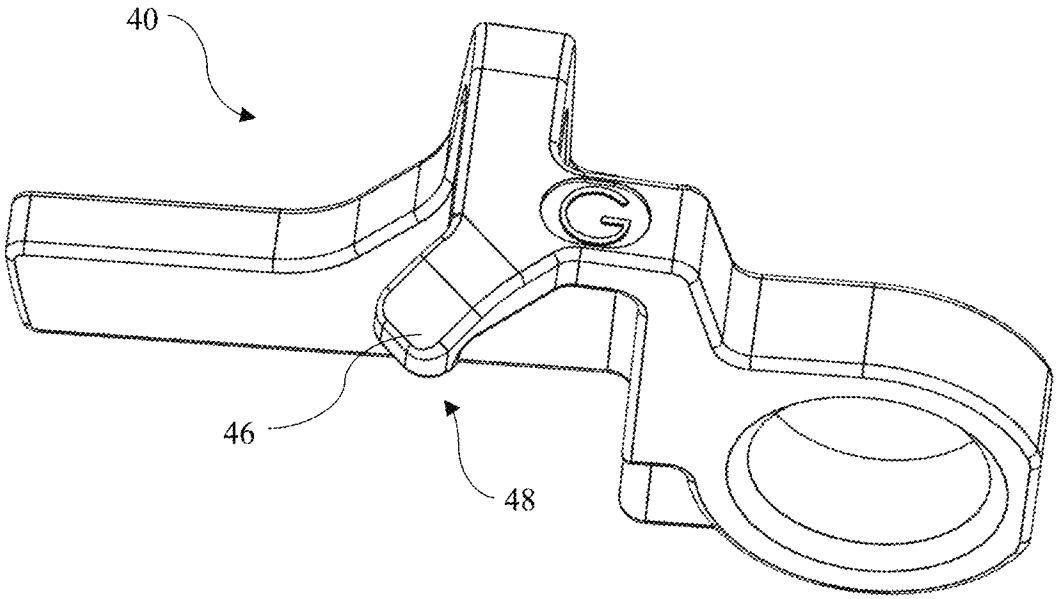
FIG. 6A is a first perspective view of another exemplary follower transfer adapter as disclosed herein.
Figure 6B:
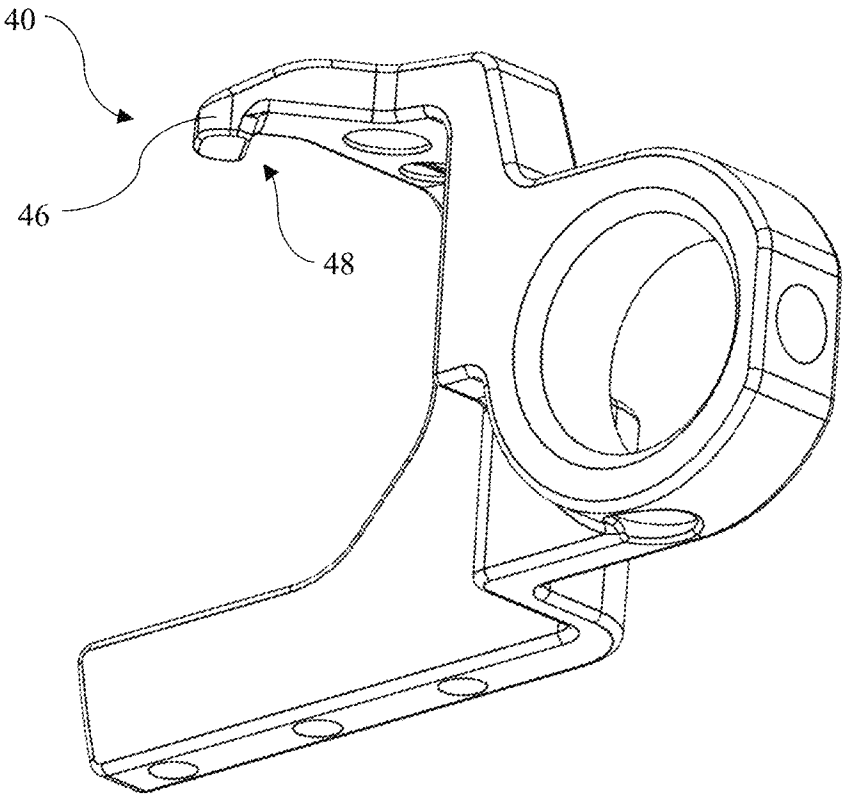
FIG. 6B is a second perspective view of the exemplary follower transfer adapter of FIG. 6A.
Figure 7A:
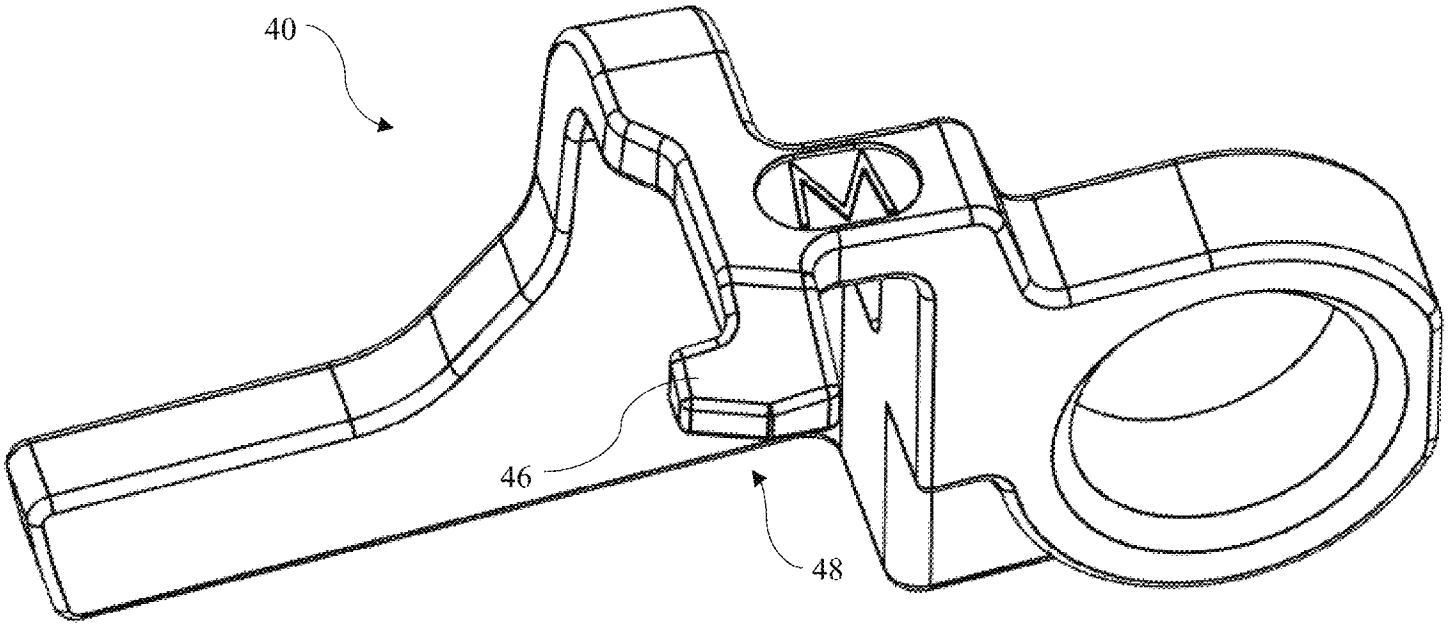
FIG. 7A is a first perspective view of yet another exemplary follower transfer adapter as disclosed herein.
Figure 7B:
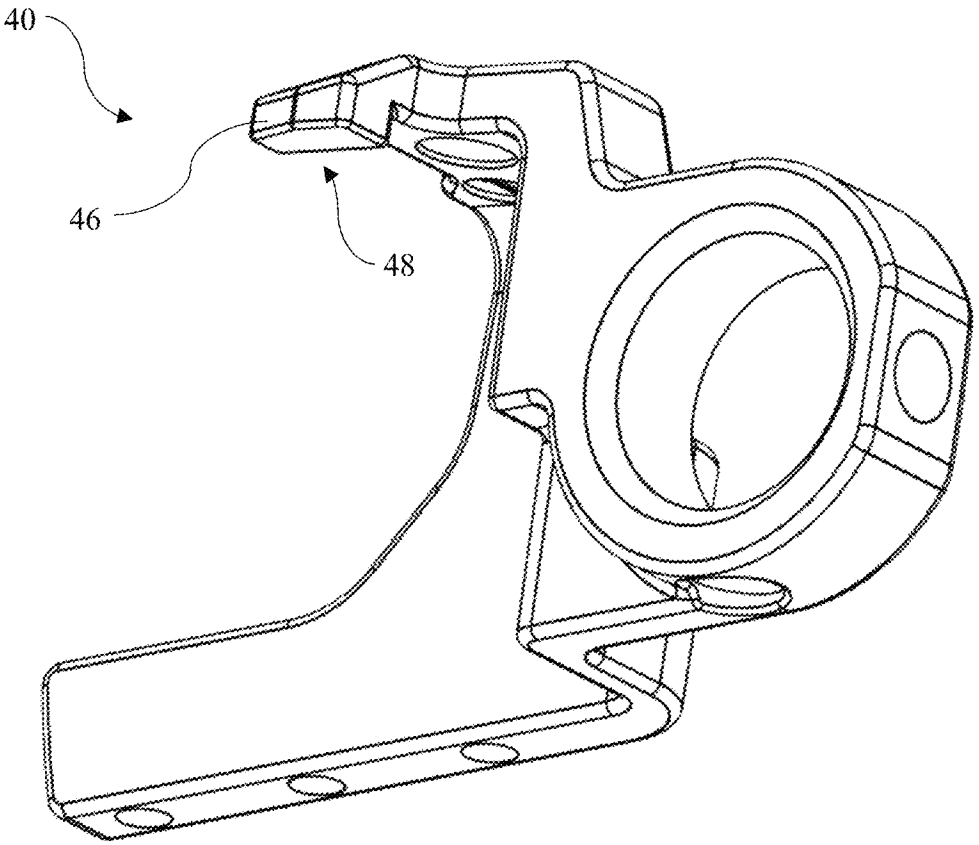
FIG. 7B is a second perspective view of the exemplary follower transfer adapter of FIG. 7A.

The bolt catch 20 and the components that engage the follower 102, which together form assembly 30, cooperate to engage the follower and, in response, move the bolt catch to the catching position. Referring also to FIG. 5, the assembly 30 comprises a follower transfer adapter 40 that is pivotable about a second axis 42. The follower transfer adapter 40 comprises an overhang lip 46 that extends transversely to the longitudinal axis 14 of the firearm 10 and into a path of travel of a follower 102 of a magazine 100. The overhang lip 46 defines an engagement portion 48 that contacts the follower 102 as the follower feeds the last round from the magazine to the firearm 10. In some optional aspects, the engagement portion 48 of the follower transfer adapter 40 is positioned between the second axis 42 and the bolt catch 20 along the longitudinal axis 14 of the firearm.

In this example, the follower transfer adapter 40 defines a through-hole 45. The follower transfer adapter 40 is pivotable about a pivot pin 47 that extends through the through-hole 45 of the follower transfer adapter 40. The second axis 42 extends through a central axis 49 of the pivot pin 47.

Figure 2:
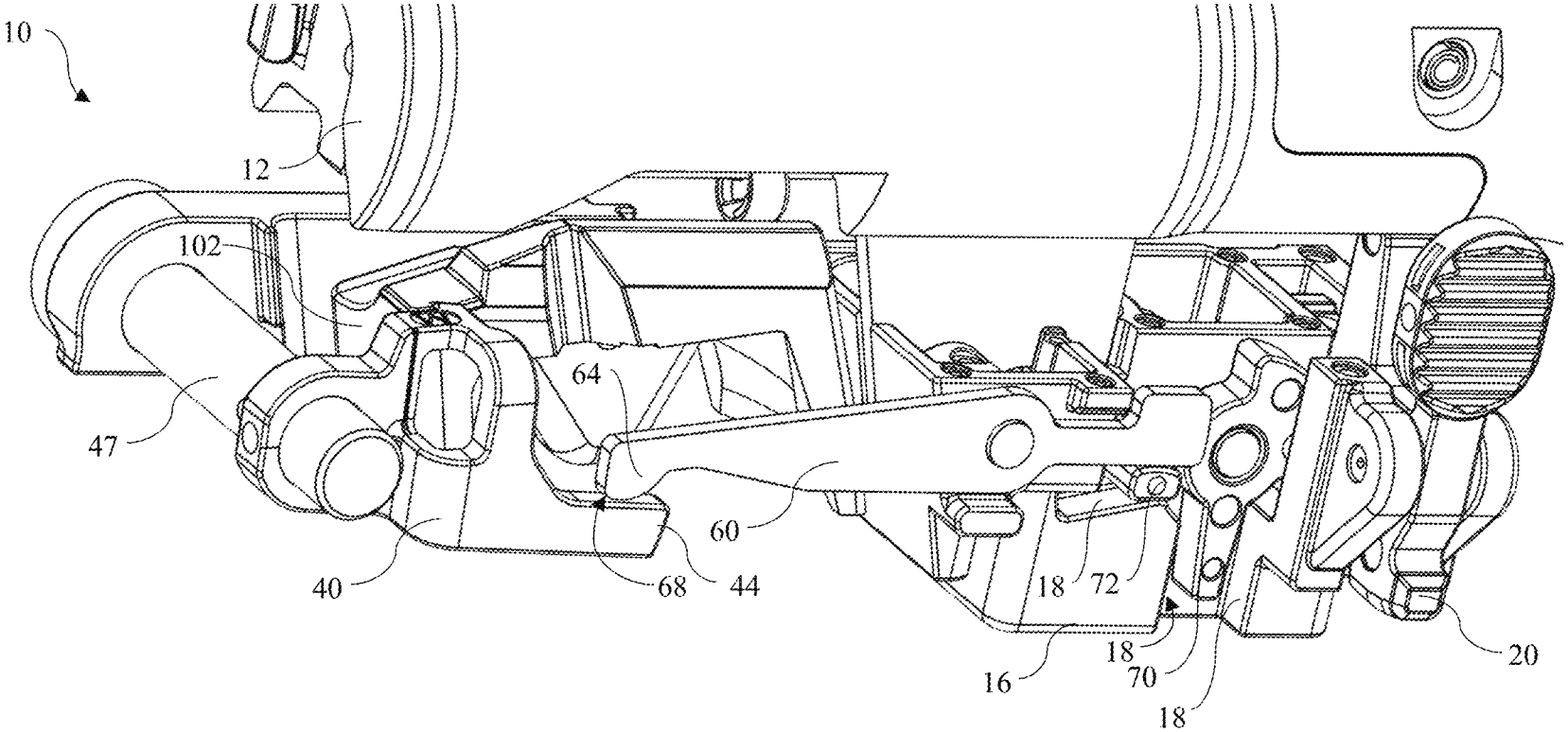
FIG. 2 is a perspective view of the firearm of FIG. 1, with elements omitted to show various components.
Figure 3:
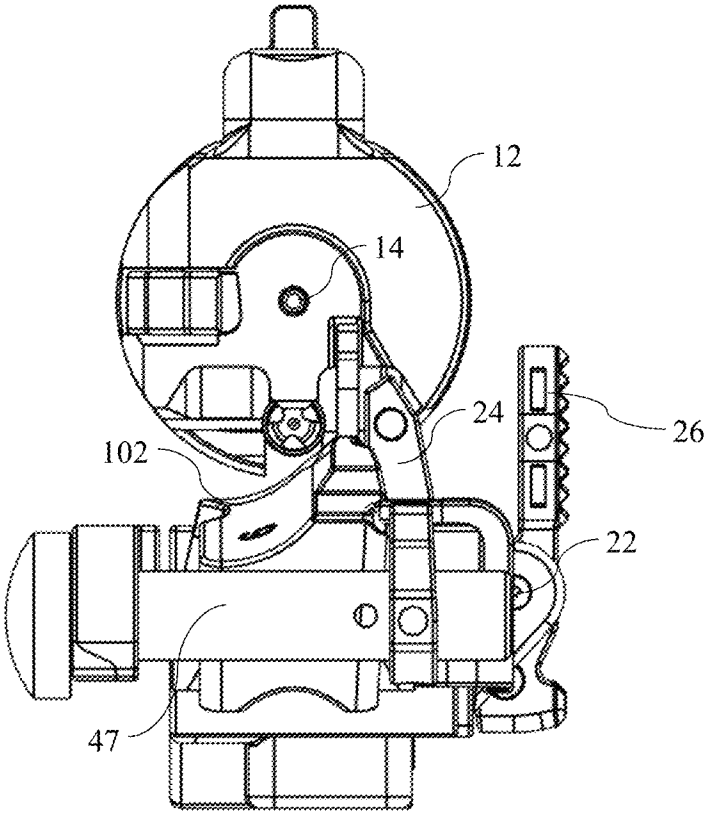
FIG. 3 is a front end view of the firearm of FIG. 1, with elements omitted to show various components.

The assembly 30 further comprises a linkage 50 that transfers rotational movement of the follower transfer adapter 40, in response to the follower 102 engaging the follower transfer adapter, to rotation of the bolt catch 20 to the catching position. The linkage 50 includes a first lever 60 that is pivotable about a third axis 62 and second lever 70 that is pivotable about a fourth axis 72, the third and fourth axes being parallel or substantially parallel (e.g., within 10 degrees of parallel) to the second axis 42. As the follower 102 of the magazine 100 lifts the follower transfer adapter 40, causing the follower transfer adapter 40 to rotate about the second axis 42, a rearwardly extending leg 44 of the follower transfer adapter 40 lifts upwardly on a front portion 64 of the first lever 60. In turn, a rear portion 66 of the first lever biases downwardly on a front portion 74 of the second lever 70, thereby causing a rear leg 76 of the second lever 70 to bias upwardly against the bolt catch 20 and rotate the bolt catch toward the catching position (within the path of travel of the bolt). As shown in FIG. 2, the front portion 64 of the first lever 60 has a rounded surface 68 that contacts the rearwardly extending leg 44 of the follower transfer adapter 40.

Figure 4:
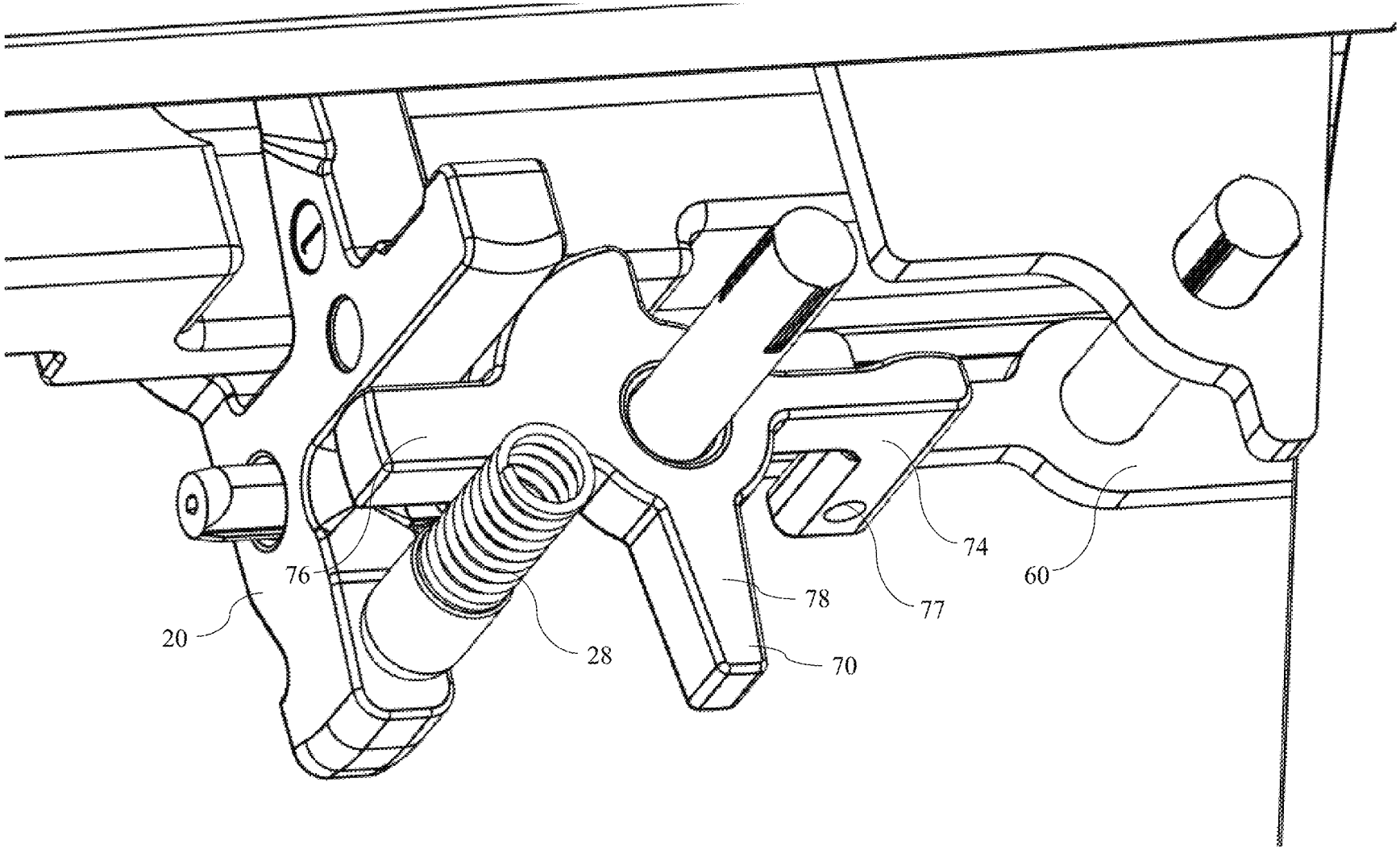
FIG. 4 is a perspective view of the firearm of FIG. 1 on an opposite side of that of FIG. 2, with elements omitted to show various components.

As shown in FIGS. 1 and 4, the front portion 74 of the second lever 70 has a transversely extending portion 77 that engages the first lever. The second lever 70 comprises a leg 78 that extends perpendicularly or substantially perpendicularly (e.g., within 10 degrees of perpendicular) to the fourth axis 72 and lessens the moment force caused by the first lever by limiting out-of-plane rotation. The normal force exerted on the second lever from the first lever is offset from the pivot point between the pin and the second lever. The leg 76 helps to counteract the moment force created in the offset, and the corresponding displacement. The leg 76 also cooperates with the frame 16 to limit rotational movement of the second lever and, thus, the linkage 50 by engagement between the leg 76 and limiting surfaces 18 of the frame 16. That is, the limiting surfaces 18 are positioned to engage the leg 76 after a predetermined amount of rotation to inhibit further rotation. In this example, the frame 16 comprises a bolt catch housing, and the limiting surfaces 18 are defined by portions of the bolt catch housing. Accordingly, as should be understood, the frame 16 can include a plurality of components including, for example, the lower receiver and the bolt catch housing.

The assembly 30 permits adapting the firearm 10 for use with different magazines (e.g., different magazine types). The follower transfer adapter 40 illustrated in FIG. 5 is configured to engage a follower of a double stack magazine, the magazine having a catch notch at approximate mid-length of the tube on the right-hand side. In various exemplary aspects, the follower transfer adapter can be configured for use with a magazine such as those produced by GLOCK® or SIG SAUER®. The follower transfer adapter 40 can be selected for use with a particular magazine (having a particular follower). The pivot pin 47 can be removed from the firearm to release a first follower transfer adapter, and a second follower transfer adapter can replace the first, with the pivot pin inserted through the through-hole of the second follower transfer adapter to retain the second follower transfer adapter within the firearm. FIGS. 6A-7B illustrate further follower transfer adapters for engaging followers of different magazines.

Additional details of an exemplary firearm as disclosed herein, including a lower receiver and an insert coupled to the lower receiver, are provided in U.S. Provisional Patent Application No. 63/508,426, filed Jun. 15, 2023, the entirety of which is hereby incorporated by reference herein.

What is claimed is:

1. An assembly for holding a bolt of a firearm in an open position, the firearm having a longitudinal axis, the assembly comprising:

a bolt catch pivotable about a first axis toward and away from a catching position, wherein, in the catching position, a portion of the bolt catch is within a path of travel of the bolt;

a follower transfer adapter that is pivotable about a second axis, wherein the follower transfer adapter comprises an engagement portion that is configured to engage a follower of a magazine, wherein the engagement portion is positioned between the second axis and the bolt catch along the longitudinal axis of the firearm;

a linkage that is configured to transfer rotational movement of the follower transfer adapter to rotation of the bolt catch;

wherein the linkage comprises:

a first lever that is pivotable about a third axis that is parallel to the second axis; and a second lever that is pivotable about a fourth axis that is parallel to the second and third axes, wherein the first lever is in contact with the follower transfer adapter so that rotation of the follower transfer adapter effects rotation of the first lever, wherein the first lever is in contact with the second lever so that rotation of the first lever effects rotation of the second lever, and wherein the second lever is in contact with the bolt catch so that rotation of the second lever effects rotation of the bolt catch wherein the second axis is transverse to the longitudinal axis of the firearm.

2. The assembly of claim 1, wherein the second lever comprises a leg that cooperates with a frame of the firearm to counteract a moment force perpendicular to the fourth axis.

3. The assembly of claim 1, wherein the follower transfer adapter comprises an overhang lip that extends transversely to the longitudinal axis of the firearm and into a path of travel of the follower to define the engagement portion.

4. The assembly of claim 1, wherein the engagement portion of the follower transfer adapter is configured to engage the follower of the magazine as the follower feeds the last round from the magazine to the firearm.

5. The assembly of claim 1, further comprising a biasing element that biases the bolt catch away from the catching position.

6. The assembly of claim 1, wherein the follower transfer adapter comprises a rearwardly extending leg that biases against a front portion of the first lever.

7. The assembly of claim 6, wherein the front portion of the first lever comprises a rounded surface that contacts the rearwardly extending leg of the follower transfer adapter.

8. The assembly of claim 6, wherein the second lever comprises a rear portion and a front portion, wherein the assembly is configured so that rotation of the follower transfer adapter upon engagement with the follower lifts the front portion of the first lever, wherein upon lifting of the front portion of the first lever, a rear portion of the first lever is configured to bias downwardly on the front portion of the second lever, and wherein upon downward bias of the front portion of the first lever on the front portion of the second lever, a rear leg of the second lever is configured to bias upwardly against the bolt catch.

9. The assembly of claim 1, wherein the bolt catch comprises an actuator that pivots outwardly as the bolt catch moves to the catching position.

10. The assembly of claim 1, wherein the follower transfer adapter defines a through-hole, wherein the assembly further comprises a pivot pin that extends through the through-hole of the follower transfer adapter, wherein the second axis extends through a central axis of the pivot pin.

11. The assembly of claim 1, wherein the first axis is parallel to the longitudinal axis of the firearm.

12. An assembly for holding a bolt of a firearm in an open position, the firearm having a longitudinal axis, the assembly comprising:

a bolt catch pivotable about a first axis;

a follower transfer adapter that is pivotable about a second axis, wherein the follower transfer adapter comprises an engagement portion that is configured to engage a follower of a magazine;

a linkage that is configured to transfer rotational movement of the follower transfer adapter to rotation of the bolt catch, wherein the linkage comprises:

a first lever that is pivotable about a third axis that is parallel to the second axis; and a second lever that is pivotable about a fourth axis that is parallel to the second and third axes, wherein the first lever is in contact with the follower transfer adapter so that rotation of the follower transfer adapter effects rotation of the first lever, wherein the first lever is in contact with the second lever so that rotation of the first lever effects rotation of the second lever, and wherein the second lever is in contact with the bolt catch so that rotation of the second lever effects rotation of the bolt catch; and wherein the second axis is transverse to the longitudinal axis of the firearm.

13. A firearm comprising:

a frame;

a bolt that moves reciprocally along a longitudinal axis relative to the frame;

an assembly for holding the bolt in an open position, the assembly comprising:

a bolt catch pivotable about a first axis toward and away from a catching position, wherein, in the catching position, a portion of the bolt catch is within a path of travel of the bolt;

a follower transfer adapter that is pivotable about a second axis, wherein the follower transfer adapter comprises an engagement portion that is configured to engage a follower of a magazine, wherein the engagement portion is positioned between the second axis and the bolt catch along the longitudinal axis of the firearm;

a linkage that is configured to transfer rotational movement of the follower transfer adapter to rotation of the bolt catch; and wherein the linkage of the assembly comprises:

a first lever that is pivotable about a third axis that is parallel to the second axis;

a second lever that is pivotable about a fourth axis that is parallel to the second and third axes, wherein the first lever is in contact with the follower transfer adapter so that rotation of the follower transfer adapter effects rotation of the first lever, wherein the first lever is in contact with the second lever so that rotation of the first lever effects rotation of the second lever, and wherein the second lever is in contact with the bolt catch so that rotation of the second lever effects rotation of the bolt catch.

14. The firearm of claim 13, further comprising the magazine.

15. A method for adapting the firearm of claim 13 for the magazine, the method comprising:

positioning, within the firearm, the follower transfer adapter, wherein the follower transfer adapter is configured for use with the magazine.

16. The method of claim 15, further comprising inserting a pivot pin through the through-hole of the follower transfer adapter.

17. The method of claim 16, further comprising:

removing the pivot pin from the through hole of the follower transfer adapter;

removing the follower transfer adapter from the firearm;

positioning a second follower transfer adapter within the firearm, wherein the second follower transfer adapter comprises a through hole; and inserting the pivot pin through the through hole of the second follower transfer adapter.

* * * * *